US005422430A

United States Patent [19]

Ikeya et al.

[11] Patent Number: 5,422,430

[45] Date of Patent: Jun. 6, 1995

[54] ELECTRICAL MUSICAL INSTRUMENT PROVIDING SOUND FIELD LOCALIZATION

[75] Inventors: Tadahiko Ikeya; Tokuji Hayakawa, both of Hamamatsu, Japan

[73] Assignee: Yamaha Corporation, Japan

[21] Appl. No.: 953,063

[22] Filed: Sep. 29, 1992

[30] Foreign Application Priority Data

Oct. 2, 1991 [JP] Japan ..... 3-282180

[51] Int. Cl.[6] ..... G10H 7/00

[52] U.S. Cl. ..... 84/626; 84/630; 84/DIG. 9; 84/DIG. 26; 84/DIG. 27

[58] Field of Search ..... 84/600, 601, 626, 630, 84/661, DIG. 9, DIG. 26, DIG. 27

[56] References Cited

U.S. PATENT DOCUMENTS

| | | | |
|---|---|---|---|
| 5,027,689 | 7/1991 | Fujimori | 84/622 |
| 5,119,712 | 6/1992 | Kato | 84/626 |
| 5,127,306 | 7/1992 | Mitsuhashi et al. | 84/665 |
| 5,153,362 | 10/1992 | Toda et al. | 84/625 |
| 5,159,140 | 10/1992 | Kimpara et al. | 84/600 |
| 5,166,464 | 11/1992 | Sakata et al. | 84/662 |

*Primary Examiner*—William M. Shoop, Jr.
*Assistant Examiner*—Jeffrey W. Donels
*Attorney, Agent, or Firm*—Graham & James

[57] ABSTRACT

An electronic musical instrument capable of providing an optimum sound field localization, such as key scale panning, suitable for a tone color selected from a plurality of tone colors by a player. A panning data for dividing a tone signal into right and left tone signals is generated in accordance a selected tone color and tone pitch of a tone signal to be generated. The panning is executed by using the panning data.

18 Claims, 11 Drawing Sheets

FIG. 7

KEY SCALE PANNING TABLE

| MIDI KEY CODE / KEY SCALE PANNING TABLE NUMBER | 21 ~ 25 | 26 ~ 30 | 31 ~ 35 | 36 ~ 40 | 41 ~ 46 | 47 ~ 52 | 53 ~ 58 | 59 ~ 64 | 65 ~ 70 | 71 ~ 76 | 77 ~ 82 | 83 ~ 88 | 89 ~ 93 | 94 ~ 98 | 99 ~ 103 | 104 ~ 108 |
|---|---|---|---|---|---|---|---|---|---|---|---|---|---|---|---|---|
| 1 | 1 | 1 | 2 | 2 | 3 | 3 | 4 | 4 | 5 | 5 | 6 | 6 | 7 | 7 | 8 | 8 |
| 2 | 2 | 2 | 3 | 3 | 4 | 4 | 5 | 5 | 6 | 6 | 7 | 7 | 8 | 8 | 9 | 9 |
| 3 | 3 | 3 | 4 | 4 | 5 | 5 | 6 | 6 | 7 | 7 | 8 | 8 | 9 | 9 | 10 | 10 |
| 4 | 4 | 4 | 5 | 5 | 6 | 6 | 7 | 7 | 8 | 8 | 9 | 9 | 10 | 10 | 11 | 11 |
| 5 | 5 | 5 | 6 | 6 | 7 | 7 | 8 | 8 | 9 | 9 | 10 | 10 | 11 | 11 | 12 | 12 |
| 6 | 6 | 6 | 7 | 7 | 8 | 8 | 9 | 9 | 10 | 10 | 11 | 11 | 12 | 12 | 13 | 13 |
| 7 | 7 | 7 | 8 | 8 | 9 | 9 | 10 | 10 | 11 | 11 | 12 | 12 | 13 | 13 | 14 | 14 |
| 8 | 8 | 8 | 9 | 9 | 10 | 10 | 11 | 11 | 12 | 12 | 13 | 13 | 14 | 14 | 15 | 15 |
| 9 | 1 | 2 | 3 | 4 | 5 | 6 | 7 | 8 | 8 | 9 | 10 | 11 | 12 | 13 | 14 | 15 |
| 10 | 2 | 3 | 4 | 5 | 6 | 7 | 7 | 8 | 8 | 9 | 9 | 10 | 11 | 12 | 13 | 14 |
| 11 | 3 | 4 | 5 | 6 | 6 | 7 | 7 | 8 | 8 | 9 | 9 | 10 | 10 | 11 | 12 | 13 |

FIG. 8

| STAGE MODE PANNING DATA CONVERSION TABLE | | | | | | | | | | | | | | | |
|---|---|---|---|---|---|---|---|---|---|---|---|---|---|---|---|
| PANNING DATA | L | | | | | | | C | | | | | | | R |
| | 1 | 2 | 3 | 4 | 5 | 6 | 7 | 8 | 9 | 10 | 11 | 12 | 13 | 14 | 15 |
| MODIFIED DATA | 3 | 4 | 5 | 6 | 7 | 7 | 8 | 8 | 8 | 9 | 9 | 10 | 11 | 12 | 13 |

FIG. 9A

| DRUMS (DRUM SET) PANNING TABLE | | | | | | |
|---|---|---|---|---|---|---|
| KEY CODE | 21 | 22 | 23 | ---------- | 107 | 108 |
| PANNING DATA | 6 | 3 | 9 | ---------- | 10 | 14 |

FIG. 9B

| STAGE MODE DRUMS PANNING TABLE | | | | | | |
|---|---|---|---|---|---|---|
| KEY CODE | 21 | 22 | 23 | ---------- | 107 | 108 |
| PANNING DATA | 6 | 4 | 9 | ---------- | 9 | 13 |

ELECTRICAL MUSICAL INSTRUMENT PROVIDING SOUND FIELD LOCALIZATION

BACKGROUND OF THE INVENTION a) Field of the Invention

The present invention relates to an electronic musical instrument capable of generating musical tones of various tone colors. More particularly, the present invention relates to an electronic musical instrument capable of providing an optimum sound field localization, such as key scale panning, suitable for a selected tone color.

b) Description of the Related Art

Some natural musical instruments have a different sound field for each tone pitch of a sound. For example, a grand piano has a keyboard with 88 keys extended to the right and left sides as viewed from a player, each key having a set of string striking mechanisms which strikes two or three strings in response to the performance of a player. Some instruments drive only one string at the low tone pitch. The position at which a sound is generated in response to the performance of a player, corresponds to the position where the string striking mechanism strikes a string. The string striking mechanisms are also disposed extending to the right and left sides as viewed from a player. Therefore, there are different sound generating positions for high tone pitch side and low tone pitch side. A different sound generating position for each tone pitch is clearly sensed, particularly by a player.

Some of recent electronic musical instruments simulate the sound generating positions of a natural musical instrument by changing the sound generating position in accordance with a tone pitch, as disclosed for example in Japanese Utility Model Laid-open Publication No. 61-49397. For example, a plurality of loudspeakers are installed within an electronic musical instrument to the right and left sides as viewed from a player. The levels of sounds to be generated at the right and left side loudspeakers are changed in accordance with the tone pitch of a depressed key, to make the sound generating position correspond to the tone pitch. This configuration is called a key scale panning or sound field localization.

In a conventional electronic musical instrument capable of executing the key scale panning, a panning data corresponding to the tone pitch of a sound to be generated is read from a table, and a tone signal is divided into right and left tone signals in accordance with the panning data to generate musical tone signals. The table stores panning data beforehand in accordance with which the levels of sounds to be generated at the right and left side loudspeakers are determined in order to obtain the sound field suitable for the tone pitch.

Generally, electronic musical instruments generate sounds by selecting a desired tone color from a plurality of tone colors. The key scale panning is not necessary for some tone colors. Therefore, the key scale panning is not executed for all tone colors, but it is executed only for predetermined tone colors.

In the conventional electronic musical instrument described above, when a tone color which requires the key scale panning is selected, the same key scale panning is executed irrespective of the type of the selected tone color. Therefore, the range of sound field localization becomes too narrow or wide depending upon a selected tone color.

SUMMARY OF THE INVENTION

It is an object of the present invention to provide an electronic musical instrument capable of providing an optimum sound field localization suitable for a tone color selected from a plurality type of tone colors by a player or the like.

According to one aspect of the present invention, there is provided an electronic musical instrument adapted for generating a musical sound with sound field localization, comprising: means for selecting a tone color of the musical tone to be generated from the instrument; means for outputting tone pitch information of the musical tone to be generated from the instrument; means for receiving the selected tone color and the outputted tone pitch information, and determining and outputting information on sound field localization for the musical sound to be generated from the instrument; means for generating a tone signal based on the selected tone color and the outputted tone pitch information; and means for producing a musical sound based on the tone signal and the information on sound field localization.

It is preferable to prepare a table which stores sound field localizing data for each tone pitch and for each tone color, so that the sound field localizing data for each tone pitch can obtained by referring to the table at the selected tone color.

The tone color selecting means selects one of a plurality of tone colors. The sound field localization data is generated in accordance with a selected tone color and tone pitch information for the execution of the tone field localization, thereby providing an optimum tone field localization suitable for each selected tone color. A too narrow or wide range of sound filed localization will not be set for each tone color, allowing to play or listen to a music with substantially the same psychological property as that of a natural musical instrument.

BRIEF DESCRIPTION OF THE DRAWINGS

FIG. 7 conceptually shows the contents of the key scale panning table;

FIG. 8 conceptually shows the contents of the stage mode panning data conversion table;

FIGS. 9A and 9B conceptually show the contents of the drums panning table;

DESCRIPTION OF THE PREFERRED EMBODIMENTS

Embodiments of the present invention will be described with reference to the accompanying drawings. Hereinbelow, the word "panning" will be used according to the conventional use, which should cover the general sound field localization.

Figure 1:
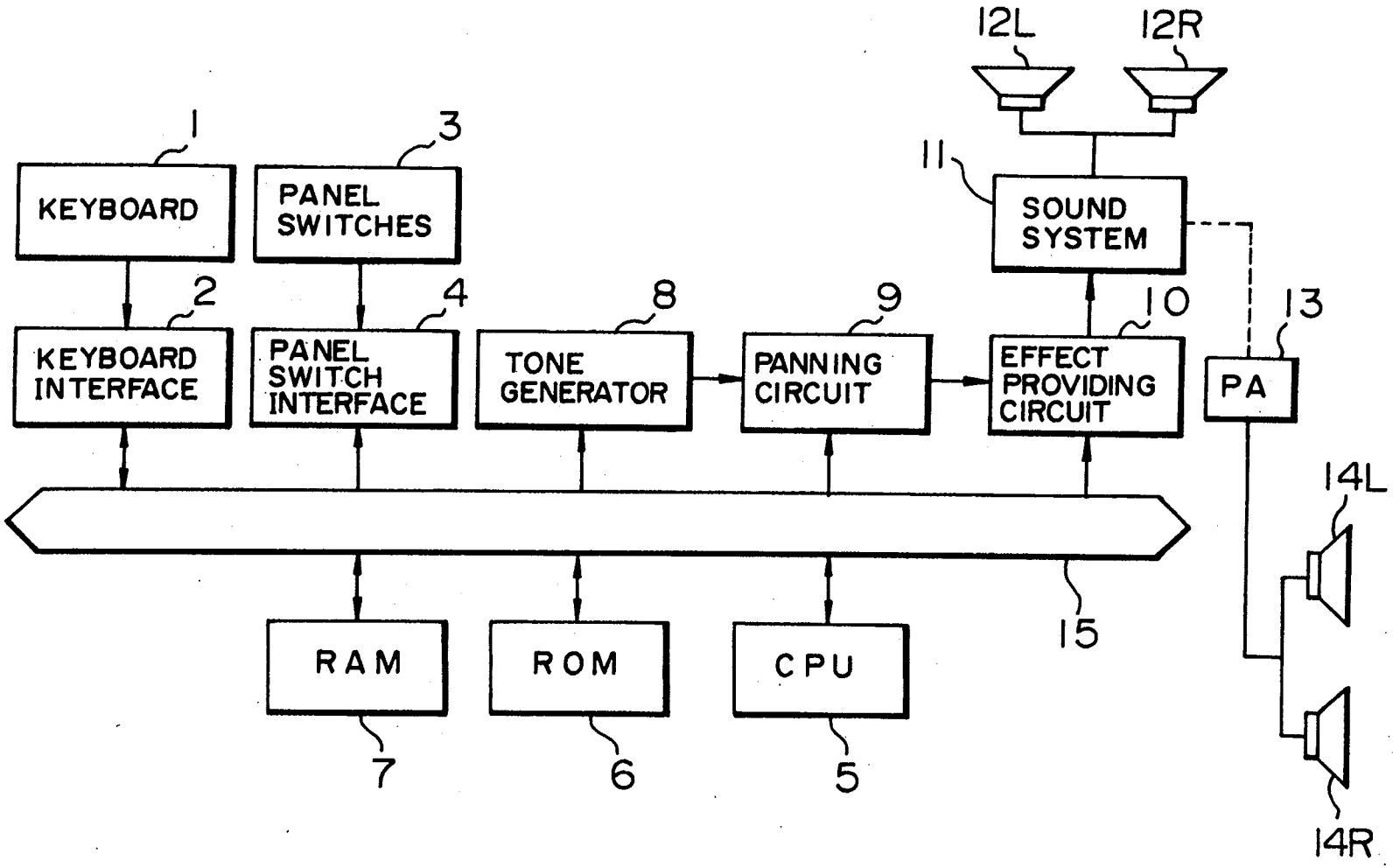
FIG. 1 is a block diagram showing an embodiment of an electronic musical instrument according to the present invention.

FIG. 1 is a block diagram showing an embodiment of an electronic musical. instrument according to the present invention. The electronic musical instrument of this embodiment has a keyboard 1 with a plurality of keys, a keyboard interface 2 for sending an output (key-on signal, key-off signal, key code representing a tone pitch, or the like) of the keyboard 1 to a bidirectional bus line 15, panel switches 3 mounted on a panel of the musical instrument and assigned various functions, a panel switch interface 4 for sending an output of each panel switch to the bus line 15, a central processing unit (CPU) 5 for controlling the whole operation of the musical instrument, a read-only memory (ROM) 6, and a random access memory (RAM) 7. R0M 6 stores programs to be executed by CPU 5, various tables, constants, and the like. RAM 7 is allocated with various working registers, flags, and the like.

The electronic musical instrument has also a musical tone generator 8 for generating a desired tone signal in accordance with an instruction from CPU 5, a panning circuit 9 for dividing a tone signal supplied from the tone generator 8 into the right and left side tone signals in accordance with a given panning data, an effect providing circuit 10 for providing particular effects to right and left tone signals supplied from the panning circuit 9, and a sound system 11 for generating sounds in accordance with tone signals provided with particular effects by the effect providing circuit 10. The sound system 11 has built-in loudspeakers 12L and 12R connected.

The built-in loudspeaker 12L is mounted within the musical instrument on the left side as viewed from a player. The built-in loudspeaker 12R is mounted within the instrument on the right side as viewed from a player. The musical instrument has output terminals via which an external public address (PA) system 13 can be connected to the sound system 11. The PA system 13 amplifies tone signals for the built-in loudspeaker 12L, and supplies them to a left side external loudspeaker 14L to generate sounds. Similarly, the PA system 13 amplifies tone signals for the built-in loudspeaker 12R, and supplies them to a right side external loudspeaker 14R to generate sounds. The distance between the right and left side external loudspeakers 14R and 14L is generally much wider than that between the built-in loudspeakers 12R and 12L.

Next, the panning circuit 9 and its peripheral circuits will be described in detail.

Figure 2:
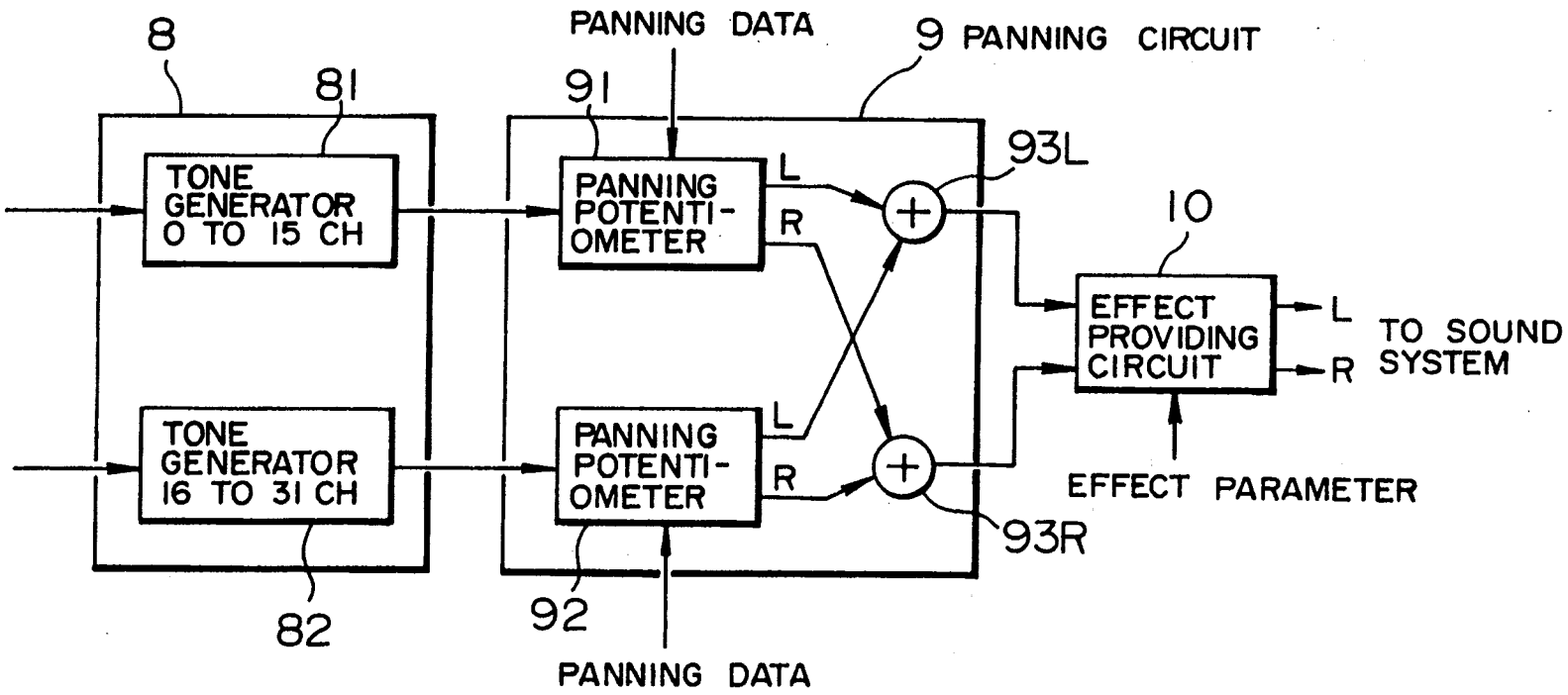
FIG. 2 shows the details of the panning circuit and its peripheral circuits of the electronic musical instrument shown in FIG. 1.

FIG.2 shows the details of the panning circuit 9 and its peripheral circuits. The tone generator 8 has a first tone generator 81 for generating tone signals for the 0-th to 15-th channels, and a second tone generator 82 for generating tone signals for the 16-th to 31-st channels. The panning circuit 9 includes a first panning potentiometer 91, second panning potentiometer 92, and adders 93L and 93R.

When CPU 5 instructs the tone generator 8 to generate a tone signal while designating a certain channel, this tone signal is generated by the first tone generator 81 at one of the 0-th to 15-th channel, or by the second tone generator 82 at one of the 16-th to 31-st channel. The tone signal generated by the first tone generator 81 is inputted to the first panning potentiometer 91, and the tone signal generated by the second tone generator 82 is inputted to the second panning potentiometer 92.

The panning potentiometer 91 divides an input tone signal into tone signals of two series (right (R) and left (L) sides) in accordance with panning data. Similarly, the panning potentiometer 92 divides an input tone signal into tone signals of two series (right (R) and left (L) sides) in accordance with the panning data.

Figure 3:
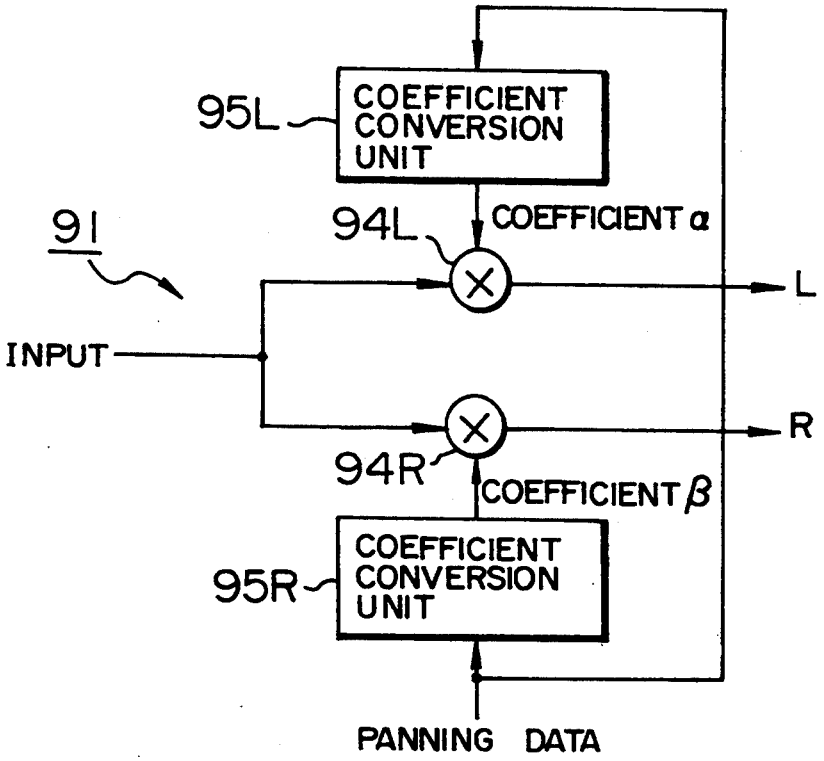
FIG. 3 shows the details of the panning potentiometer of the panning circuit shown in FIG. 2.

FIG. 3 shows the detailed structure of the panning potentiometer 91. The panning potentiometer 92 has the same structure. Only the structure of the panning potentiometer 91 will be described below. The panning potentiometer 91 has two multipliers 94L and 94R, and two coefficient converters 95L and 95R. The panning data supplied to the panning potentiometer 91 is inputted to the two coefficient converters 95L and 95R. The coefficient converters 95L and 95R output coefficients $\alpha$ and $\beta$ determined from the panning data to the multipliers 94L and 94R.

Figure 4:
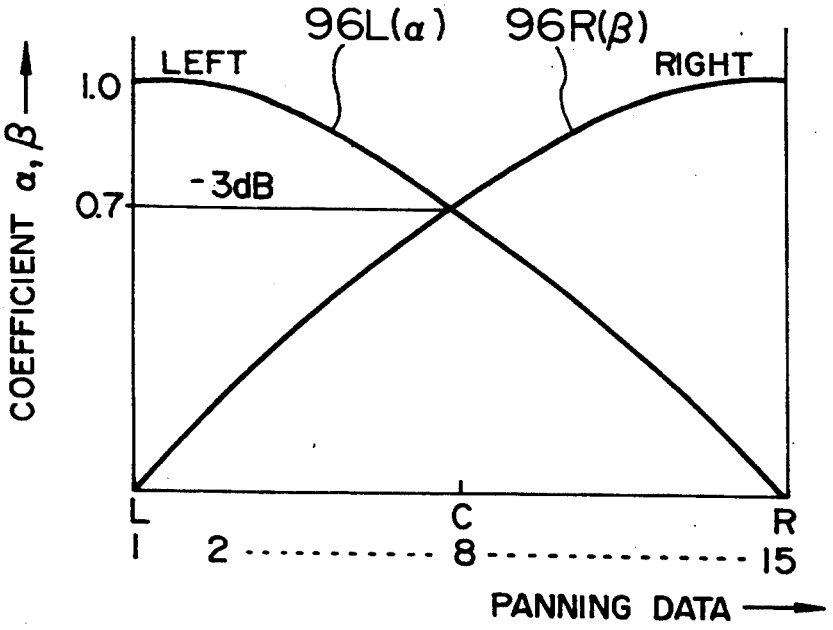
FIG. 4 is a graph showing coefficient conversion curves used by the coefficient conversion unit shown in FIG. 3.

FIG. 4 shows the characteristics of the coefficient converters 95L and 95R. The abscissa represents an input panning data, and the ordinate represents output coefficients $\alpha$ and $\beta$. The panning data is an integer from "1" to "15". The coefficient converter 95L outputs the coefficient a determined from an input value "1" to "15" by using the curve 96L shown in FIG. 4. As seen from this curve 96L, the coefficient $\alpha$ changes from "1.0" for the panning data "1" to "0" for the panning data "15", gradually decreasing its value. Similarly, the coefficient converter 95R outputs the coefficient a determined from an input value "1" to "15" by using the curve 96R shown in FIG. 4. As seen from this curve 96R, the coefficient $\beta$ changes from "0" for the panning data "1" to "1.0" for the panning data "15", gradually increasing its value.

Referring back to FIG. 3, a tone signal inputted to the panning potentiometer 91 is supplied to the right and left multipliers 94R and 94L. The multiplier 94L multiplies the input tone signal by the coefficient $\alpha$ from the coefficient converter 95L, to output the result as the left (L) side tone signal. Similarly, the multiplier 94R multiplies the input tone signal by the coefficient $\beta$ from the coefficient converter 95R, to output the result as the right (R) side tone signal.

As seen from the structure of the panning potentiometer shown in FIG. 3 and the characteristic curves shown in FIG. 4, the level of the L side tone signal is maximum and the level of the R side tone signal is "0", respectively for the panning data "1". As the panning data increases its value to "2", "3", . . . , the level of the L side tone signal gradually decreases and the level of the R side tone signal gradually increases (within the range where the level of the L side tone signal is higher than that of the R side tone signal). For the panning data "8", both the L and R side tone signals take the same level. As the panning data increases its value to "9", "10", . . . , the level of the L side tone signal gradually decreases and the level of the R side tone signal gradually increases (within the range where the level of the L side tone signal is lower than that of the R side tone signal). For the panning data "15", the level of the L side tone signal is "0", and that of the R side tone signals maximum.

In this manner, the panning potentiometer 91 or 92 divides an input tone signal into right and left tone signals of two series.

Referring back to FIG. 2, L side tone signals outputted From the first and second panning potentiometers 91 and 92 are inputted to the adder 93L. The adder 93L adds the L side tone signals together and outputs the addition result as the L side tone signal For each channel. Similarly, R side tone signals outputted from the first and second panning potentiometers 9l and 92 are inputted to the adder 93R. The adder 93R adds the R side tone signals together and outputs the addition result as the R side tone signal for each channel.

The L side tone signal outputted from the adder 93L is supplied to the effect providing circuit 10. Similarly, the R side tone signal outputted from the adder 93R is supplied to this circuit 10. The effect providing circuit 10 provides the right and left input tone signals with particular effects, in accordance with given effect parameters. The final right and left tone signals are sent to the sound system 11.

This electronic musical instrument has 32 sound generating channels. These channels are processed time sequentially. Namely, the above-described processing is executed for each channel during a time slot assigned to this channel.

The operation and function of each panel switch of the electronic musical instrument will be described with reference to FIGS. 5A and 5B which are the plan views of the panel.

Figure 5A:
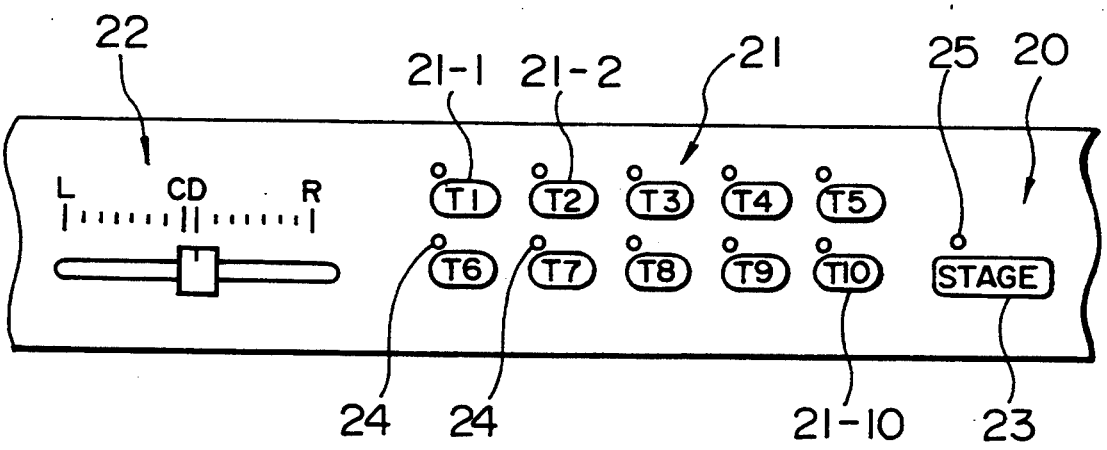
FIGS. 5A and 5B are plan views of the panel of the electronic musical instrument shown in FIG. 1.

FIG. 5A is a plan view showing some of panel switches of the electronic musical instrument. In FIG. 5A, various panel switches 3 are mounted on the panel 20. Of the panel switches 3, reference numeral 21 represents ten tone color select switches, reference numeral 22 represents a panning switch, and reference numeral 23 represents a stage mode switch. An LED 24 is mounted near at each tone color select switch 21. An LED 25 is mounted near at the stage mode switch 23.

A desired tone color can be selected by depressing the tone color select switch 21. For example, upon depression of the tone color select switch 21-1, the musical instrument selects a piano tone color as a first tone color T1. In this state, the LED 24 for the tone color select switch 21-1 turns on and illuminates. Piano tones are thereafter generated as it is played. Similarly, upon depression of the tone color select switch 21-2, the musical instrument selects an electric piano tone color as a second tone color T2. In this state, the LED 24 for the tone color select switch 21-2 turns on and illuminates. Electric piano tones are thereafter generated as it is played. Similarly, saxophone musical tones are assigned as a third tone color T3 , . . . , and keyboard percussion tones are assigned as a tenth tone color T10.

Figure 5B:
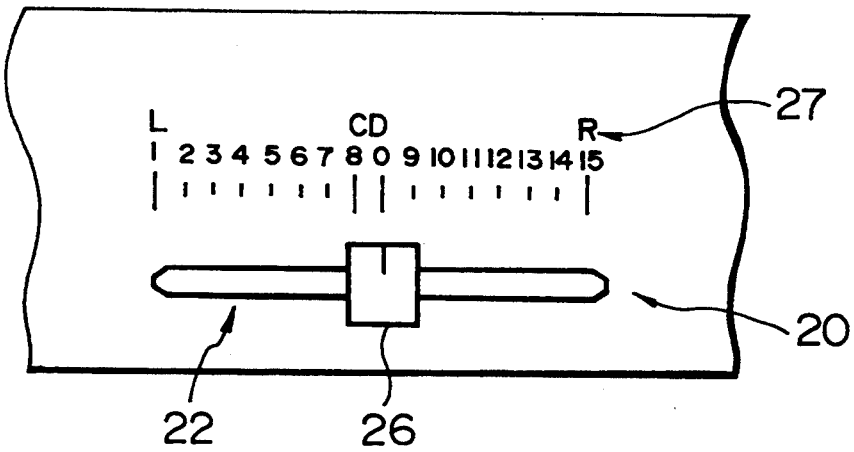

FIG. 5B is an enlarged view of the panning switch or manipulator 22. The panning switch 22 has a slide variable resistor 26. A scale 27 is provided at the area above the slide variable resistor 26. The panning data can be selected by manually sliding the variable resistor 26 to the right or left side to a desired position of the scale 27, or a default panning data may be designated by sliding the variable resistor 26 to a predetermined position.

When the slide variable resistor 26 is positioned to one of values "1" to "15" on the scale 27, the panning at this value is performed. A character "L" engraved on the panel above the scale 27 stands for the left side, "C" stands For the center, and "R" stands for the right side. For example, when the variable slide resistor 26 is aligned with the value "1" under "L" at the leftmost, musical tones are generated at the leftmost localized position. As the number increases from "1" to "2", to "3", . . . , the tone level gradually increases on the right side. When the variable slide resistor 26 is aligned with the value "8" or "C", musical tones are generated at the centrally localized position. As the slide variable resistor 26 is moved farther to the right passing over the central position and the value "0", musical tones are generated at the right side localized position. As the slide variable resistor 26 is farther moved to the right and aligned with the rightmost value "15" or "R", musical tones are generated at the rightmost localized position. In this manner, panning can be set manually. If a manual panning is performed, a key scale panning is not executed.

When the variable slide resistor 26 is aligned with the value "0" or "D" at the center of the scale 27, panning is executed by using a default panning data. When the default panning data is selected, it is determined whether the panning at the default panning data is executed without executing the key scale panning, or the key scale panning is executed. This determination is automatically made in accordance with a selected tone color. When panning is executed by using the default panning data without executing the key scale panning, musical tones of a selected tone color are generated at a predetermined localized position. A tone color for which the key scale panning is not executed, is the third tone color T3 of a saxophone for example. The key scale panning is executed for a predetermined tone color to localize musical tones in the same manner as the tone color of a natural musical instrument. Therefore, the electronic musical instrument can be played as if a natural musical instrument having the selected tone color is being played. The tone color for which the key scale panning is executed, is the second tone color T2 of an electric piano for example.

The electronic musical instrument of this embodiment provides a specific tone color whose musical tones are generated by using stereophonically sampled data. For example, piano tones of the first tone color T1 are generated by reproducing them from stereophonically sampled data. In the stereophonic sampling, actual sounds of a natural piano instrument are stereophonically sampled. Therefore, without executing the key scale panning, the right and left sampled data itself is used to generate musical tones, providing proper localization of musical tones suitable for each tone pitch. With the electronic musical instrument of this embodiment, when a tone color using stereophonically sampled data is selected and the panning switch 22 is aligned with the default value "D", the right and left sampled data themselves are used without executing the ordinary panning or key scale panning.

The electronic musical instrument of this embodiment can select the keyboard percussion as the tenth tone color T10 (tone color selected when the tone color select switch 21-10 shown in FIG. 5 is depressed). In this keyboard percussion, each key is assigned a different percussion tone color. When a key is depressed, percussion sounds having the assigned tone color are generated. Therefore, when the keyboard percussion tone color is selected and the panning switch 22 is aligned with the default value "D", panning is executed by using a panning data predetermined for each key.

When the stage mode switch 23 shown in FIG. 5A is depressed, the electronic musical instrument changes its mode from the normal mode to the stage mode. When the stage mode switch 23 is again depressed during the stage mode, the normal mode resumes. The LED 25 lights off during the normal mode, and lights on during the stage mode.

During the stage mode, the sound field of musical tones are concentrated to the central position or area. The stage mode will be detailed below.

For the electronic musical instrument of this embodiment, tone colors, effect parameters, and panning data are set so as to obtain the optimum effects of musical tones to be generated by the built-in loudspeakers. Namely, the panning data is set so that musical tones to be generated by the right and left built-in loudspeakers having a predetermined distance are properly localized. This electronic musical instrument has output terminals to which the external PA system can be connected. Tone signals for the left side built-in loudspeaker are amplified by the PA system and supplied to the left side loudspeaker of the PA system, and tone signals for the right side built-in loudspeaker are amplified by the PA system and supplied to the right side loudspeaker of the PA system.

The distance between the PA system loudspeakers is generally wider than that between the built-in loudspeakers. Therefore, if the panning data which was set for the built-in loudspeakers are used for the panning of the PA system loudspeakers, musical tones generated from the PA system loudspeakers are sensed as if an instrument having a size corresponding to the distance between the PA system loudspeakers is being played. For this reason, the embodiment electronic musical instrument provides the stage mode. In the stage mode, the panning data is corrected so that musical tones can be localized to the central area by a predetermined degree. Accordingly, if musical tones are to be generated from the PA system external loudspeakers in the stage mode, an optimum panning can be obtained.

Next, registers and tables to be used by the electronic musical instrument of this embodiment will be described.

(a) TCN: A tone color number register for storing the number of a presently selected tone color. When the tone color select switch 21 is depressed, a tone color number corresponding to the depressed switch is set to TCN. Specifically, the number of the first tone color T1 (piano) is "1", the number of the second tone color T2 (electric plane) is "2", . . . , and the number of the tenth tone color T10 (keyboard percussion) is "10".

(b) SPD: A panning switch data register for storing the current position of the panning switch 22 shown in FIGS. 5A and 5B. The panning switch 22 supplies an integer value from "0" to "15" representing the position of the panning switch 22 (the value of the scale 27 indicated at the position of the slide variable resistor 26 shown in FIG. 5B), this output value being set to SPD.

(c) SMF: A stage mode flag taking "1" during the stage mode, and "0" during the normal mode. Each time the stage mode switch 23 shown in FIG. 5A is depressed, SMF changes its value alternately between "0" and "1".

(d) CH: A tone channel register for storing the number of a channel assigned to sound generation.

(e) PD: A panning data register for storing the panning data representing a division ratio of a tone signal to the right and left sides.

(f) MPD: A read panning data register for temporarily storing a panning data read from a tone color parameter table PTBL to be described later.

(g) KSPN: A key scale panning table number register for temporarily storing a key scale panning table number read from the tone color parameter table PTBL.

(h) KC: A key code register for storing the key code of a depressed key. The value of each key code conforms with the musical instrument digital interface MIDI specification, and takes an integer value from "21" to "108".

Figure 6:
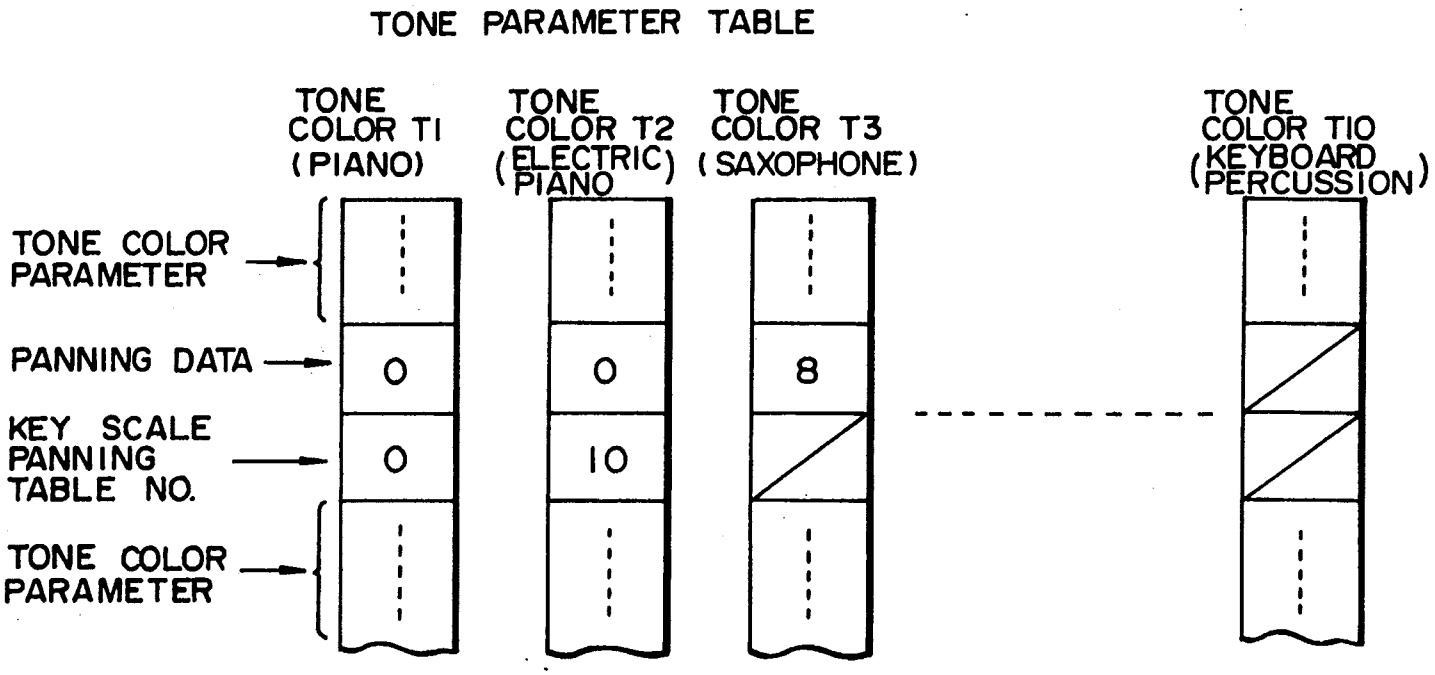
FIG. 6 conceptually shows the contents of the tone color table.

(i) PTBL: A tone color parameter table. FIG. 6 conceptually shows part of the contents of this table. The tone color parameter table stores tone color parameters for ten selectable tone colors, and panning data for each tone color. In the example shown in FIG. 6, the panning data "0" for the tone colors T1 and T2 indicates that tone signals for such a tone color are subjected to the key scale panning or they are generated using stereophonically sampled data. The panning data other than "0", such as "8" for the tone color T3, indicates that tone signals for such a tone color are subjected to panning by using a default panning data without executing the key scale panning. Specifically, during the normal mode, the value stored in PTBL is used as the panning data, and during the stage mode, the value stored in PTBL is modified to another value by using a conversion table SMPTBL to be described later. This modified value is used as the panning data. In this example, no panning data is being stored for the tone color T10. The reason for this is that the tone color T10 stands for the keyboard percussion, and the panning data for each key is read from a table DPTBL or SMDPTBL to be described later. Therefore, the panning data field of PTBL for this tone color is not required to be referred to, and remains undefined.

The tone color parameter table PTBL also stores a key scale panning table number for each tone color. For the panning data "0" for each tone color, this key scale panning table number is referred to. For the key scale panning table number other than "0", the key scale panning data in the key scale panning table KSPTBL identified by the panning table number is used for the key scale panning. The key scale panning table number "0" indicates that tone signals for a tone color are generated by using stereophonically sampled data. For the panning data other than "0" for each tone color such as the tone color T3, the key scale panning is not executed, so that the key scale panning data table number is not required to be referred to, and remains undefined.

(j) KSPTBL: A key scale panning table. FIG. 7 conceptually shows the contents of this table which stores a list of panning data using as search keys the key scale panning number assigned to each tone color and the key code (tone pitch information). For example, when a key having a key code KC "36" is depressed under the condition that the tone color T2 is being selected (the key scale panning table number "5" is obtained from the tone color parameter table shown in FIG. 6), the panning data "5" is obtained.

(k) SMPTBL: A stage mode panning data conversion table. FIG. 8 conceptually shows the contents of this table. During the normal mode, the panning data read from the above-described tables itself can be inputted to the panning circuit 9 shown in FIGS. 1 and 2. However, during the stage mode, in order to realize the panning to b e localized to the central area, the panning data for the normal mode is modified and inputted to the panning circuit 9. This table SMPTBL is used for such a modification. As seen from FIG. 8, the panning data for the normal mode is modified to values which localize musical tones to the central area.

(l) DPTBL: A drums (drum set) panning table for the normal mode. The contents of this table are shown in FIG. 9A. This table is referred to when the tone color T10 of the keyboard percussion is selected during the normal mode. By using the panning data stored in this table, the panning is executed for each key code (to which a different percussion sound is assigned).

(m) SMDPTBL: A drums panning table for the stage mode. The contents of this table are shown in FIG. 9B. This table is referred to when the tone color T10 of the keyboard percussion is selected during the stage mode. By using the panning data stored in this table, the panning is executed for each key code. The panning data in this table is set so that each percussion sound is localized more to the central area than the panning data in the table DPTBL is used.

The registers TCN, SPD, CH, PD, MPD, SMF, KSPN, and KC are allocated to RAM 7. The tables PTBL, KSPTBL, SMPTBL, DPTBL, and SMDPTBL are allocated to ROM 6. These tables may be allocated to RAM 7. The tables may be structured so that a user can edit the data stored therein. In the following description, each register name is assumed to represent both the name and contents of the register. For example, TCN represents the name of this register and the tone color number stored in this register.

Next, the operation of the electronic musical instrument of this embodiment will be described with reference to the flow charts shown in FIGS. 10 to 13.

Figure 10:
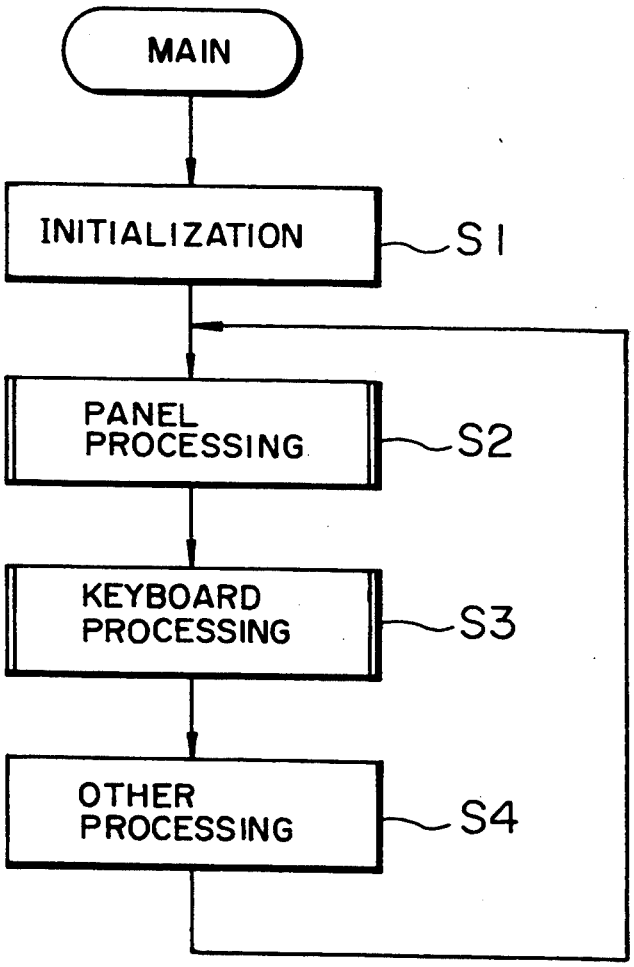
FIG. 10 is a flow chart of the main routine to be executed by the electronic musical instrument.

Reference is made to the main routine shown in FIG. 10. When the operation of the electronic musical instrument starts, each register and other circuit elements are initialized at step S1. As the initial value of the tone color number TCN, the number of a predetermined default tone color is set. The initial mode is the normal mode, and the stage flag is set to "0". The initial position of the panning switch 2 is set to the panning switch data register SPD.

A panel processing routine is executed at step S2, a keyboard processing routine is executed at step S3, another processing is executed at step S4, and thereafter the control returns to step S2 to repeat the processes of steps S2 to S4. In the panel processing routine, the panel switch 3 on the panel 20 shown in FIG. 2 is scanned to determine if the panel switch 3 was activated. If activated, predetermined processes are executed. At the keyboard processing, the keyboard 1 is scanned to determine if any key was depressed. If depressed, predetermined processes are executed.

Figure 11:
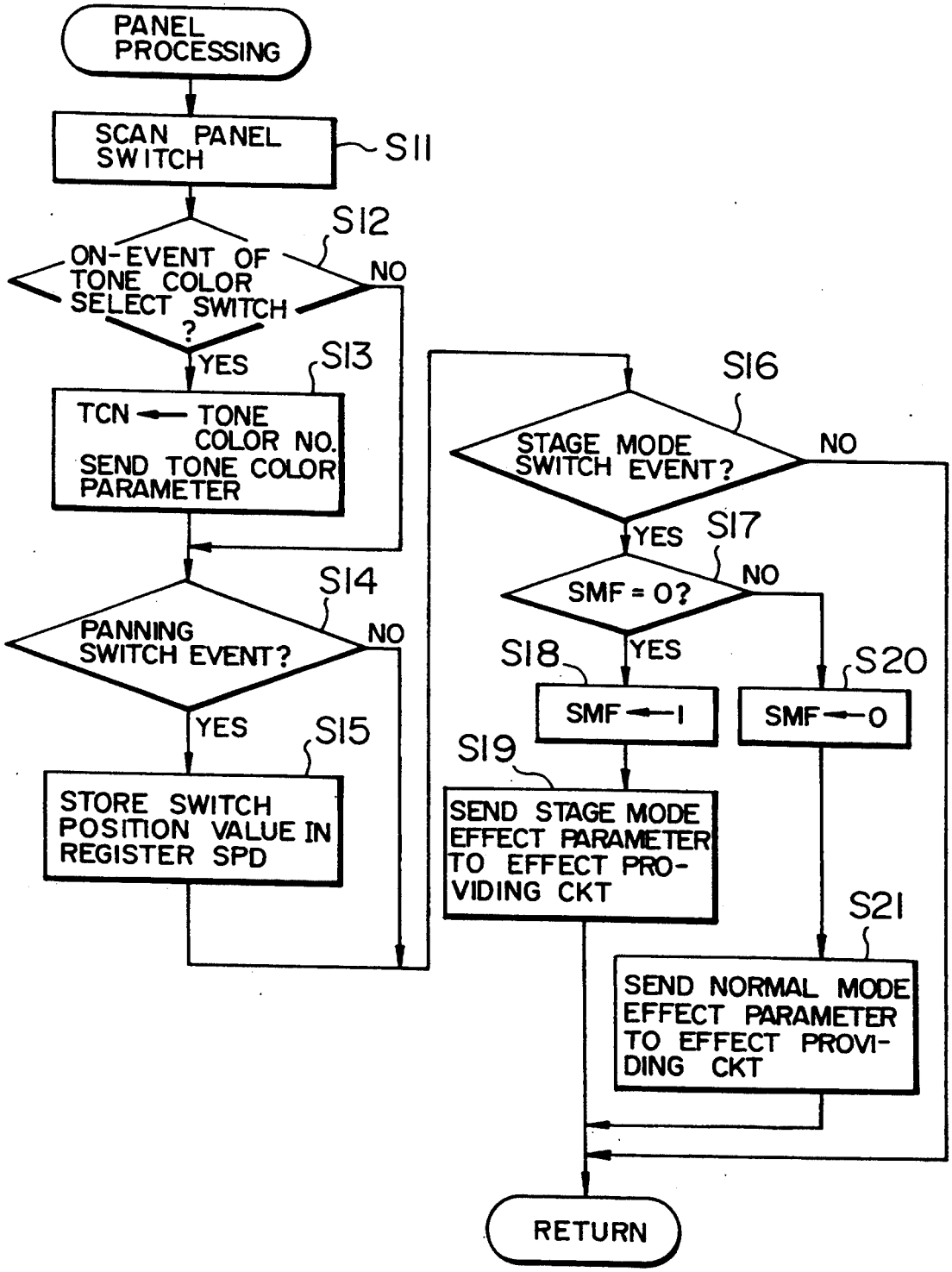
FIG. 11 is a flow chart showing the panel processing routine to be executed by the electronic musical instrument.

Referring to the flow chart of the panel processing routine (at step S2 in FIG. 10) shown in FIG. 11, the panel switch 3 on the panel 20 is scanned at step S11. It is checked at step S12 based upon the scan result whether there is an on-event of any tone select switch (on-event of any one of the ten switches 21 shown in FIG. 2). If there is an on-event, at step S13 the tone color number of the turned-on tone color select switch is set to the tone color number register TCN, and the tone color parameter corresponding to the tone color number is read from ROM 6 and sent to the tone generator 8. In this manner, musical tones to be generated thereafter have the selected tone color. After step S13, the control advances to step S14. If there is no on-event of the tone color switch at step S12, the control advances directly to step S14.

It is checked at step S14 whether there is any operation event of the panning switch 22 shown in FIG. 2. If there is an operation event, at step S15 the value representing the position of the panning switch 22 is stored in the panning switch data register SPD and thereafter the control advances to step S16. If there is no operation event at step S14, the control advances directly to step S16.

At step S16 it is checked if there is an on-event of the stage mode switch 23 shown in FIG. 5. If there is an on-event, the control advances to step S17, and if not, the control returns to the main routine. It is checked at step S17 whether the stage mode flag SMF is "0", i.e., whether the present mode is the normal mode or not. If the present mode is the normal mode, the stage mode flag SMF is set to "1" at step S18 to switch to the stage mode. At step S19 the stage mode effect parameter is sent to the effect providing circuit 10 and thereafter the control returns to the main routine.

If the present mode is the stage mode at step S17, the stage mode flag SMF is set to "0" at step 20 to switch to the normal mode. At step S21, the normal mode effect parameter is sent to the effect providing circuit 10 and thereafter the control returns to the main routine.

The stage mode effect parameter and normal mode effect parameter are stored for each tone color in ROM 6. Effect select switches may be provided to select a particular effect, read the corresponding effect parameter from ROM 6, and send it to the effect providing circuit 10.

Figure 12:
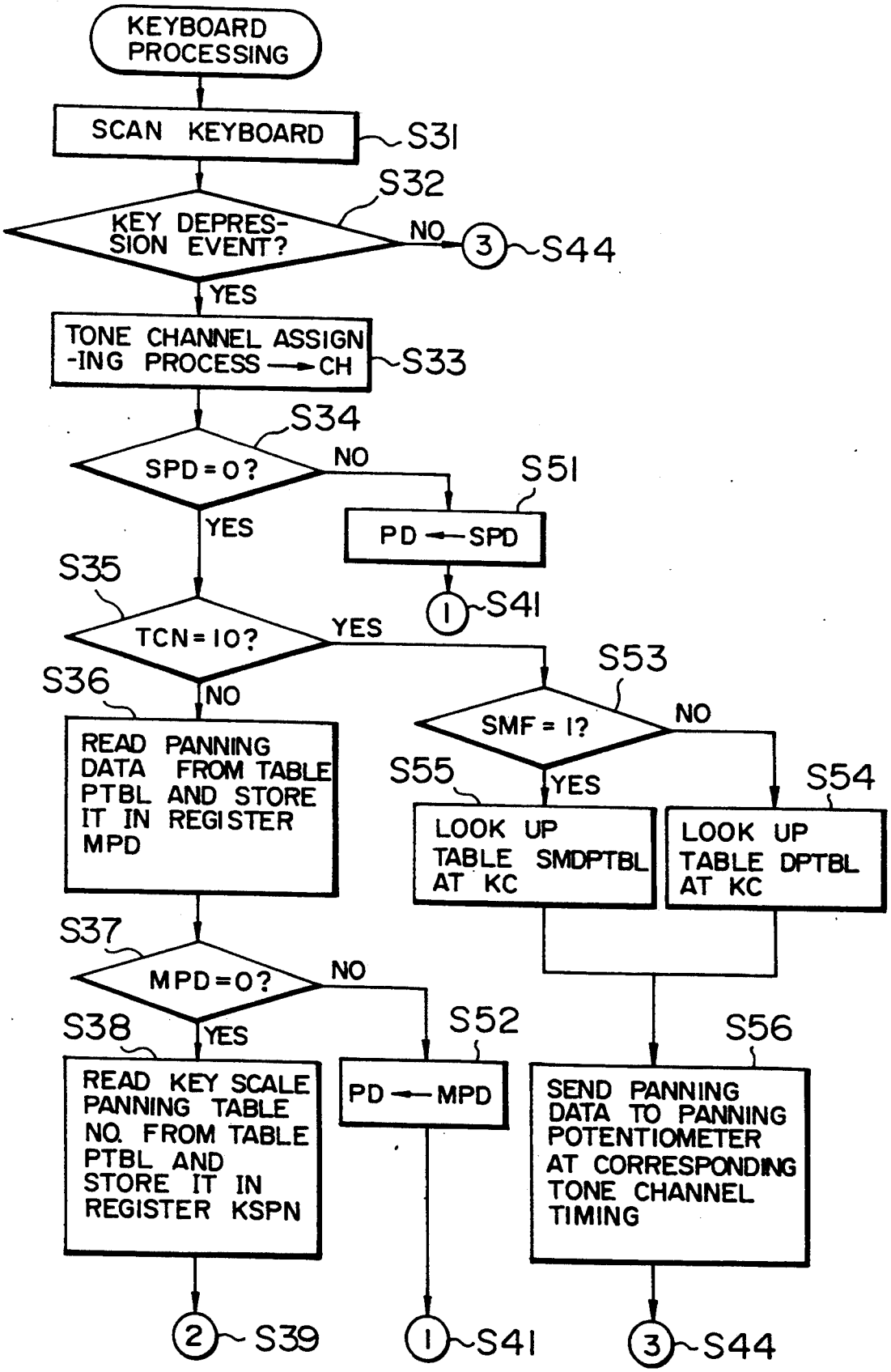
FIG. 12 and 13 are flow charts showing the keyboard processing routine to be executed by the electronic musical instrument.
Figure 13:
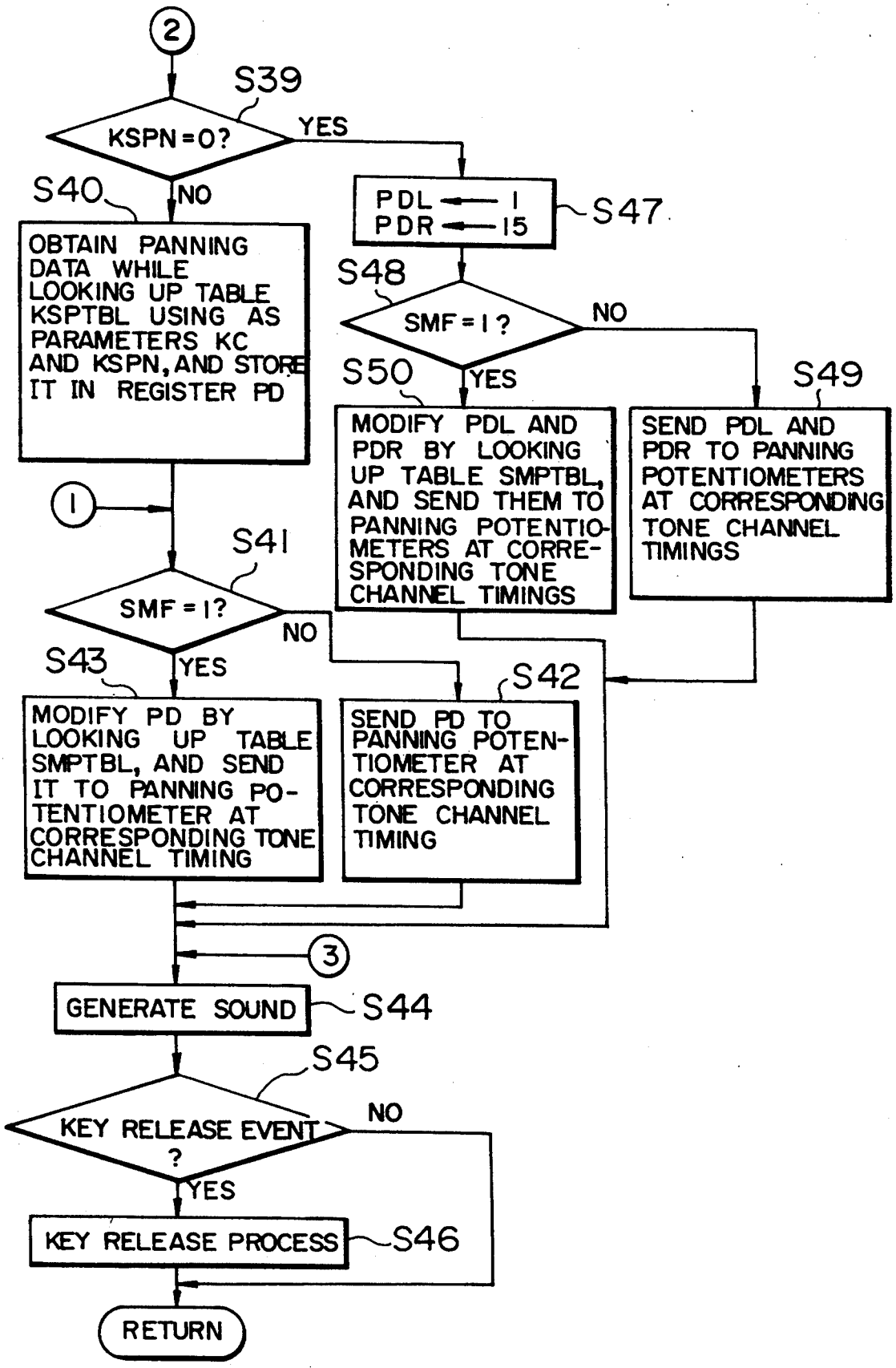

Next, referring to the flow charts shown in FIGS. 12 and 13, the keyboard processing routine will be described. In this keyboard processing routine, the keyboard 1 is scanned at step S31. Next, it is checked at step S32 whether there is any key depression event. If there is a key depression event, the control advances to step S33, and if not, the control branches to step S44. If there is a key depression event, at step S33 a tone channel is determined. The channel number of the tone channel assigned to the depressed key is set to the tone channel register CH.

Next, it is checked at step S34 whether the panning switch data SPD is "0". If "0", it means that a panning at a default value is to be executed, and the control advances to step S35. If not "0", it means that a panning at a designated value is to be executed, and the control branches to step S51. In the case of the panning at the default value, it is checked at step S35 whether the tone color number TCN is "10", i.e., whether the presently selected tone color is the keyboard percussion. If the tone color is "10", the control advances to step S53 in order to execute the keyboard percussion processing. If not "0", at step S36 the tone color parameter table PTBL shown in FIG. 6 is referred to and the panning data for the presently selected tone color is read and stored in the register MPD.

It is checked at step S37 whether the read panning data MPD is "0". If not "0", the control branches to step S52 in order to execute the panning at the fixed value. If "0", at step S38 the tone color parameter table PTBL is referred to and the key scale panning table number of the present tone color is read and stored in the key scale panning table number register KSPN.

Next, it is checked at step S39 whether the key scale panning table number KSPN is "0". If "0", it means that the present tone color is generated from stereophonically sampled data, and so the control branches to step S47 in order to execute the panning for the generation of tone signals from stereophonically sampled data. If not "0" at step S39, the control advances to step S40 to execute the key scale panning. Referring to the key scale panning table KSPTBL shown in FIG. 7, the panning data is read and stored in the panning data register PD at step S40, using as search keys the key code KC and key scale panning table number KSPN.

Next, it is checked at step S41 whether the stage mode flag SMF is "1", i.e., whether the present mode is the stage mode. If the present mode is not the stage mode but the normal mode, at step S42 the value of the panning data PD is sent to the panning circuit 9 shown in FIGS. 1 and 2 at the corresponding tone channel timing. The panning circuit 9 divides the tone signal into the right and left tone signals in accordance with the given panning data, as previously described with reference to FIGS. 2 to 4. If the present mode is the stage mode at step S41, at step S43 the value of the panning data PD is modified to a new value for the stage mode while referring to the stage mode panning data conversion table SMPTBL shown in FIG. 8, and the modified value is sent to the panning circuit 9 shown in FIGS. 1 and 2 at the corresponding tone channel timing. The panning circuit 9 divides the tone signal into the right and left tone signals in accordance with the given panning data.

After step S42 or S43, a musical sound generating process is executed at step S44. It is checked at step S45 whether there is a key release event. If there is a key release event, a key release process is executed at step S46, and thereafter the control returns to the main routine. If there is no key release event at step S45, the control returns directly to the main routine.

If the key scale panning table number KSPN is "0" at step S39, it means that the presently select tone color is generated from stereophonically sampled data, and so at step S47 the working register PDL is set with "1" and the working register PDR is set with "15". Next, it is checked at step S48 whether the stage mode flag SMF is "1", i.e., whether the present mode is the stage mode. If the present mode is not the stage mode but the normal mode, at step S49 the values "1" and "15" of the working registers PDL and PDR are sent to the panning circuit 9 at the corresponding tone channel timings.

For the tone color to be generated from stereophonically sampled data, two tone channels are required For reproducing sampled data. In this electronic musical instrument, one of the 0-th to 15-th channels is assigned to the tone channel to be used for reproducing the left side sampled data, and one of the 16-th to 31-st channels is assigned to the tone channel to be used for reproducing the right side sampled data. Since stereophonically sampled data is reproduced, it is not necessary to execute the key scale panning. At the time of sending a tone signal obtained by the left side sampled data (at the timing of the assigned channel among the 0-th to 15-th channels), the value "1" of the register PDL is supplied to the panning potentiometer 91 shown in FIG. 2 to output the left side tone signal at a level 100%. Similarly, at the time of sending a tone signal obtained by the right side sampled data (at the timing of the assigned channel among the 16-th to 31-st channels), the value "15" of the register PDR is supplied to the panning potentiometer 92 shown in FIG. 2 to output the right side tone signal at a level 100%.

If the present mode is the stage mode at step S48, at step S50 the values of the working registers PDL and PDR are modified while referring to the stage mode panning data conversion table SMPTBL shown in FIG. 8, and the modified new values are sent to the panning circuit 9 shown in FIGS. 1 and 2 at the corresponding tone channel timings. In this manner, in reproducing the stereophonically sampled data, tone signals for the stage mode are processed in order to localize them to the central area.

After step S49 or S50, the control advances to step S44 and following steps to execute the above-described processes.

If the panning switch data SPD is not "0" at step S34, it means that the panning at the manually set value is to be executed. In this case, at step S51 the value of the panning switch data SPD is set to the panning data register PD, and the control branches to step S41 to execute the panning at the manually set value of the panning switch 22 while also considering the stage mode.

If the read panning data MPD is not "0" at step S37, it means that the panning at the default value for the selected color tone is to be executed. Therefore, the value of the read panning data MPD is set to the panning data register PD at step S52, and the control branches to step S41. In this manner, the panning at the set panning data for the selected color tone is executed while also considering the stage mode.

If the tone color number TCN is "10" at step S35, it means that the keyboard percussion has been selected, and so it is checked at step S53 whether the stage mode flag SMF is "1", i.e., whether the present mode is the stage mode. If the present mode is not the stage mode but the normal mode, at step S54 the panning data PD corresponding to the key code KC is obtained by referring to the normal mode drums panning table DPTBL. If the present mode is the stage mode at step S53, at step S55 the panning data PD corresponding to the key code KC is obtained by referring to the stage mode drums panning table SMDPTBL.

After step S54 or S55, at step S56 the panning data PD is sent to the panning circuit 9 shown in FIGS. 1 and 2 at the corresponding tone channel timing. In this manner, the panning circuit 9 divides the tone signal into the right and left tone signals in accordance with the panning data, as previously described with FIGS. 2 to 4. After step S56, the control advances to step S44 and following steps to execute the above-described processes.

As described so far, according to the electronic musical instrument of this embodiment, whether the key scale panning is executed or not is determined from a selected tone color. In executing the key scale panning, the key scale panning data suitable for the selected tone color is read from the table. Therefore, an optimum key scale panning suitable for the selected tone color can be realized.

Furthermore, the stage mode is provided to localize the tone signals to the central area. Accordingly, even if external loudspeakers connected to the PA system are used, the localized area of tone signals is not unnatural, providing an optimum panning. This is also true for the case of reproducing stereophonically sampled data.

Different effect parameters are used for the stage mode and normal mode in order to provide particular effects to tone signals. Accordingly, tone signals amplified by the PA system will not become unnatural, providing an optimum effect. It is particularly desirable that the effect parameter is set so as to obtain an optimum effect when listened by a player during the normal mode and by audiences during the stage mode.

For example, for different effect parameters for the stage mode and normal mode, a pre-delay time may be changed, the pre-delay time representing a difference between a time required for a direct sound to reach and a time required for an initial reflected sound in reverberation. Specifically, if the pre-delay time is increased in some degree during the stage mode, sounds are sensed as if walls are set farther away from the musical instrument. Direct sounds are sensed more than reverberant sounds near the instrument, and the quantity of reverberant sounds increases as the position of the instrument becomes remote. It is therefore desirable to increase the quantity of reverberant sounds during the stage mode more than during the normal mode, relative to the quantity of direct sounds.

In changing an effect, an effect parameter itself is changed in the above embodiment. Alternatively, a changed effect may be obtained by running a program selected from a plurality of different programs by using a program number, the programs operating to provide different effects. An effect balance is easy to change, so additional effect balance parameters may be provided. Reverberation is used in the above description by way of example. Other effects such as chorus and flanger may be applied.

The panning circuit and panning potentiometers are not limited to those shown in FIGS. 2 and 3, but various other circuits may by used. The characteristic of coefficient conversion is not limited to that shown in FIG. 4.

A change in the panning data during the stage mode of this embodiment is executed on the assumption that there are about 50 to 100 audience members and the positions of the external loudspeakers are near the musical instrument. It is therefore necessary to change the optimum panning data if the positions of the right and left loudspeakers are placed farther away from the instrument. It is desirable that a number of stage modes corresponding to a small stage, medium stage, large stage, and so on, can be selectively used, and that an optimum panning is executed by using a panning data conversion table suitable for the selected stage. A panning conversion table may be structured so as to allow a user to change its contents.

The phase of sounds generated at the right and left can be changed by a predetermined amount according to the tone color.

The present invention has been described in connection with the above embodiments. The present invention is not limited only to the embodiments. It is apparent by those skilled in the art that various substitutions, changes, improvements, combinations and the like may be made.

We claim:

1. An electronic musical instrument adapted for generating a musical sound with sound field localization, comprising:

means for selecting a tone color of the musical tone to be generated from the instrument;

means for outputting tone pitch information of the musical tone to be generated from the instrument;

means for selecting a mode from a plurality of performance modes;

means for receiving the selected tone color, the outputted tone pitch information and the mode, and for determining and outputting information on sound field localization for the musical sound to be generated from the instrument, wherein said means for determining and outputting information on sound field localization changes a range of sound field localization for the same tone color and tone pitch depending on the selected mode;

means for generating a tone signal based on the selected tone color, the outputted tone pitch information and the mode; and means for producing a musical sound based on the tone signal and the information on sound field localization.

2. An electronic musical instrument according to claim 1, wherein said mode selecting means includes a default mode, wherein said means for determining and outputting information on sound field localization outputs a predetermined information on sound field localization.

3. An electronic musical instrument according to claim 2, wherein said means for determining and outputting information on sound field localization, depending on the selected tone color, outputs information of key-scaled sound field localization which determines sound field localization based on the tone pitch, in the default mode.

4. An electronic musical instrument according to claim 2, wherein said means for determining and outputting information on sound field localization, depending on the selected tone color, outputs information on sound field localization which is constant regardless of the tone pitch, in the default mode.

5. An electronic musical instrument according to claim 2, wherein said means for determining and outputting information on sound field localization, outputs no information on sound field localization when stereophonically sampled data are employed.

6. An electronic musical instrument according to claim 1, wherein said plurality of performance modes includes a normal mode and a stage mode.

7. An electronic musical instrument according to claim 1, wherein said receiving means includes a plurality of key scale panning tables and selects one of them based on a selected tone color.

8. An electronic musical instrument comprising:

tone signal generating means for generating a tone signal;

panning means for dividing said tone signal from said tone signal generating means into a plurality of signals;

tone color selecting means for selecting a tone color of said tone signal to be generated by said tone signal generating means;

tone pitch information outputting means for outputting tone pitch information representing a tone pitch of said tone signal to be generated by said tone signal generating means; and panning data generating means for generating panning data in accordance with said tone color selected by said tone color selecting means and said tone pitch information outputted from said tone pitch information outputting means, said panning data determining the level of each signal of said plurality of signals, and for outputting said panning data to said panning means, wherein said panning data generating means includes a switch for setting a stage mode, and when said stage mode is set, said panning data generating means changes said panning data for key scale panning so as to localize said tone signal to a central area.

9. An electronic musical instrument according to claim 8, wherein said panning data generating means generates a predetermined panning data for a first type of tone color, and generates a panning data changing with a tone color and tone pitch for a second type of tone color.

10. An electronic musical instrument according to claim 9, wherein said panning data generating means generates another panning data for a third type of tone color to be generated through stereophonically sampled data.

11. An electronic musical instrument according to claim 8, wherein said panning data generating means includes a panning switch capable of setting various types of panning, said panning switch being capable of designating a first area and a second area, said first area allowing to designate a desired one of fixed panning data, and said second area allowing to designate a key scale panning or not to designate said key scale panning.

12. An electronic musical instrument according to claim 11, wherein when said panning switch designates said second area, said panning data generating means determines from said selected tone color whether said key scale panning is executed.

13. An electronic musical instrument according to claim 8, wherein said panning means includes a pair of multipliers for receiving the same tone signal, and a pair of coefficient calculating circuits for calculating a pair of coefficients in accordance with said panning data supplied from said panning data generating means, and supplying said calculated pair of coefficients to said pair of multipliers.

14. An electronic musical instrument adapted for generating a musical sound with sound field localization, comprising:

means for selecting a tone color of the musical tone to be generated from the instrument;

means for outputting tone pitch information of the musical tone to be generated from the instrument;

means for receiving the selected tone color and the outputted tone pitch information, and determining and outputting information on sound field localization for the musical sound to be generated from the instrument;

means for generating a tone signal based on the selected tone color and the outputted tone pitch information;

means for modifying the tone signal based on the information on sound field localization; and a plurality of sound systems for producing a musical sound, wherein said modifying means changes a range of sound field localization for the same tone color and tone pitch depending on the sound system used.

15. An electronic musical instrument according to claim 14, further comprising means for selecting a mode from a plurality of modes including a normal mode and a stage mode, and designating which sound system is to be used.

16. An electronic musical instrument according to claim 15, further comprising means for adding an effect to said tone signal based on a selected mode, thereby producing a mode-dependent effect.

17. An electronic musical instrument according to claim 14, wherein said receiving means includes a plurality of key scale panning tables and selects one of them based on a selected tone color.

18. An electronic musical instrument comprising:

a first tone generator for producing a first tone signal;

a second tone generator for producing a second tone signal;

first field localizing means for affording first sound field localization to said first tone signal based on a panning data and producing a pair of first modified tone signals;

second field localizing means for affording second sound field localization to said second tone signal based on a panning data and producing a pair of second modified tone signals;

a first mixer for receiving each of one of said first and second modified tone signals, and outputting a first channel tone signal;

a second mixer for receiving each of another of said first and second modified tone signals and outputting a second channel tone signal; and means for receiving a signal indicating whether the first and second tone signals are stereophonically sampled signals or not, and disabling said first and second field localizing means when the first and second tone signals are stereophonically sampled signals.

* * * * *